US009732562B2

(12) United States Patent
Scott et al.

(10) Patent No.: US 9,732,562 B2
(45) Date of Patent: Aug. 15, 2017

(54) EARTH-BORING TOOLS HAVING SHAPED CUTTING ELEMENTS

(71) Applicant: Baker Hughes Incorporated, Houston, TX (US)

(72) Inventors: Danny E. Scott, Montgomery, TX (US); Nicholas J. Lyons, Sugar Land, TX (US); Juan Miguel Bilen, The Woodlands, TX (US); Oliver Matthews, Spring, TX (US); Rudolf Carl Pessier, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 14/791,634

(22) Filed: Jul. 6, 2015

(65) Prior Publication Data

US 2015/0308197 A1 Oct. 29, 2015

Related U.S. Application Data

(63) Continuation of application No. 13/098,123, filed on Apr. 29, 2011, now Pat. No. 9,074,435.

(Continued)

(51) Int. Cl.

*E21B 10/55* (2006.01)
*E21B 10/46* (2006.01)

(Continued)

(52) U.S. Cl.

CPC ..... *E21B 10/55* (2013.01); *E21B 10/42* (2013.01); *E21B 10/46* (2013.01); *E21B 10/5673* (2013.01)

(58) Field of Classification Search

CPC ..... E21B 10/55; E21B 10/42; E21B 10/46; E21B 10/43; E21B 10/567; E21B 10/5673

See application file for complete search history.

(56) References Cited

U.S. PATENT DOCUMENTS 4,440,246 A 4/1984 Jurgens
4,872,520 A 10/1989 Nelson (Continued)

FOREIGN PATENT DOCUMENTS

CN 2297177 Y 11/1998
CN 2686180 Y 3/2005

(Continued)

OTHER PUBLICATIONS

US 4,373,595, 02/1983, Phaal et al. (withdrawn)

(Continued)

*Primary Examiner* — Wei Wang

(74) *Attorney, Agent, or Firm* — TraskBritt

(57) ABSTRACT

Cutting elements include a volume of superabrasive material. The volume of superabrasive material comprises a front-cutting surface, an end-cutting surface, a cutting edge, and lateral side surfaces extending between and intersecting each of the front-cutting surface and the end-cutting surface. An earth-boring tool may comprise a bit body and at least one cutting element attached to the bit body. Methods of forming cutting elements comprise forming a volume of superabrasive material comprising forming a front-cutting surface, an end-cutting surface, a cutting edge, and lateral side surfaces extending between and intersecting each of the front-cutting surface and the end-cutting surface. Methods of forming earth-boring tools comprise forming a cutting element and attaching the cutting element to an earth-boring tool.

16 Claims, 8 Drawing Sheets

Related U.S. Application Data

(60) Provisional application No. 61/330,757, filed on May 3, 2010, provisional application No. 61/371,355, filed on Aug. 6, 2010.

(51) Int. Cl.
*E21B 10/42* (2006.01)
*E21B 10/567* (2006.01)

(56) References Cited

U.S. PATENT DOCUMENTS

| | | | | |
|---|---|---|---|---|
| 5,460,233 | A * | 10/1995 | Meany | E21B 10/5673 175/428 |
| 5,881,830 | A | 3/1999 | Cooley | |
| 5,890,552 | A | 4/1999 | Scott et al. | |
| 6,164,394 | A * | 12/2000 | Mensa-Wilmot | E21B 10/43 175/331 |
| 6,176,333 | B1 | 1/2001 | Doster | |
| 6,196,340 | B1 | 3/2001 | Jensen et al. | |
| 6,290,008 | B1 | 9/2001 | Portwood et al. | |
| 6,332,503 | B1 | 12/2001 | Pessier et al. | |
| 7,681,673 | B2 | 3/2010 | Kolachalam | |
| 2004/0149495 | A1 | 8/2004 | Thigpen et al. | |
| 2005/0247486 | A1 * | 11/2005 | Zhang | E21B 10/5673 175/57 |
| 2005/0247492 | A1 | 11/2005 | Shen et al. | |
| 2008/0156542 | A1 | 7/2008 | Baker et al. | |
| 2010/0059287 | A1 | 3/2010 | Durairajan et al. | |
| 2011/0155472 | A1 | 6/2011 | Lyons et al. | |
| 2011/0266070 | A1 | 11/2011 | Scott et al. | |

FOREIGN PATENT DOCUMENTS

| | | |
|---|---|---|
| CN | 2743526 Y | 11/2005 |
| EP | 0918135 A1 | 5/1999 |
| EP | 1052367 A2 | 11/2000 |

OTHER PUBLICATIONS

International Preliminary Report on Patentability, PCT/US2011/034614 dated Nov. 6, 2012, 6 pages.
International Search Report for International Application No. PCT/US2011/034614 dated Nov. 1, 2011, 4 pages.
International Written Opinion for International Application No. PCT/US2011/034614 dated Nov. 1, 2011, 5 pages.
Chinese Office Action for Chinese application No. 201180028057.7 dated Jun. 5, 2014, 8 pages.
Canadian Office Action for Canadian Application No. 2,798,040 dated Sep. 10, 2014, 3 pages.
Chinese Office Action for Chinese Application No. 201180028057.7 dated May 4, 2016, 15 pages.
European Search Report for EU Application No. 11778059.3, dated Aug. 29, 2016, 8 pages.

* cited by examiner

EARTH-BORING TOOLS HAVING SHAPED CUTTING ELEMENTS

CROSS-REFERENCE TO RELATED APPLICATIONS

This application is a continuation of U.S. patent application Ser. No. 13/098,123, filed Apr. 29, 2011, now U.S. Pat. No. 9,074,435, issued Jul. 7, 2015, which application claims the benefit of U.S. Provisional Patent Application Ser. No. 61/330,757, filed May 3, 2010 and entitled "Geometries For Cutting Elements And Methods Of Forming Such Cutting Elements," and U.S. Provisional Patent Application Ser. No. 61/371,355, filed Aug. 6, 2010, and entitled "Cutting Elements Having Curved Lateral Side Surfaces for Plowing Subterranean Formation Material, Earth-Boring Tools Including Such Cutting Elements, and Related Methods," the disclosure of each of which is incorporated herein in its entirety by this reference.

FIELD

Embodiments of the present disclosure generally relate to cutting elements that include a table of superabrasive material (e.g., polycrystalline diamond or cubic boron nitride) formed on a substrate, to earth-boring tools including such cutting elements, and to methods of forming such cutting elements and earth-boring tools.

BACKGROUND

Earth-boring tools are commonly used for forming (e.g., drilling and reaming) bore holes or wells (hereinafter "wellbores") in earth formations. Earth-boring tools include, for example, rotary drill bits, core bits, eccentric bits, bi-center bits, reamers, underreamers, and mills.

Different types of earth-boring rotary drill bits are known in the art including, for example, fixed-cutter bits (which are often referred to in the art as "drag" bits), roller cone bits (which are often referred to in the art as "rock" bits), diamond-impregnated bits, and hybrid bits (which may include, for example, both fixed cutters and roller cones). The drill bit is rotated and advanced into the subterranean formation. As the drill bit rotates, the cutters or abrasive structures thereof cut, crush, shear, and/or abrade away the formation material to form the wellbore.

The drill bit is coupled, either directly or indirectly, to an end of what is referred to in the art as a "drill string," which comprises a series of elongated tubular segments connected end-to-end that extends into the wellbore from the surface of the formation. Often various tools and components, including the drill bit, may be coupled together at the distal end of the drill string at the bottom of the wellbore being drilled. This assembly of tools and components is referred to in the art as a "bottom hole assembly" (BHA).

The drill bit may be rotated within the wellbore by rotating the drill string from the surface of the formation, or the drill bit may be rotated by coupling the drill bit to a downhole motor, which is also coupled to the drill string and disposed proximate the bottom of the wellbore. The downhole motor may comprise, for example, a hydraulic Moineau-type motor having a shaft, to which the drill bit is mounted, that may be caused to rotate by pumping fluid (e.g., drilling mud or fluid) from the surface of the formation down through the center of the drill string, through the hydraulic motor, out from nozzles in the drill bit, and back up to the surface of the formation through the annular space between the outer surface of the drill string and the exposed surface of the formation within the wellbore.

Roller cone drill bits typically include three roller cones mounted on supporting bit legs that extend from a bit body, which may be formed from, for example, three bit head sections that are welded together to form the bit body. Each bit leg may depend from one-bit head section. Each roller cone is configured to spin or rotate on a bearing shaft that extends from a bit leg in a radially inward and downward direction from the bit leg. The cones are typically formed from steel, but they also may be formed from a particle-matrix composite material (e.g., a cermet composite such as cemented tungsten carbide). Cutting teeth for cutting rock and other earth formations may be machined or otherwise formed in or on the outer surfaces of each cone. Alternatively, receptacles are formed in outer surfaces of each cone, and inserts formed of hard, wear resistant material are secured within the receptacles to form the cutting elements of the cones. As the roller cone drill bit is rotated within a wellbore, the roller cones roll and slide across the surface of the formation, which causes the cutting elements to crush and scrape away the underlying formation.

Fixed-cutter drill bits typically include a plurality of cutting elements that are attached to a face of a bit body. The bit body may include a plurality of wings or blades, which define fluid courses between the blades. The cutting elements may be secured to the bit body within pockets formed in outer surfaces of the blades. The cutting elements are attached to the bit body in a fixed manner, such that the cutting elements do not move relative to the bit body during drilling. The bit body may be formed from steel or a particle-matrix composite material (e.g., cobalt-cemented tungsten carbide). In embodiments in which the bit body comprises a particle-matrix composite material, the bit body may be attached to a metal alloy (e.g., steel) shank having a threaded end that may be used to attach the bit body and the shank to a drill string. As the fixed-cutter drill bit is rotated within a wellbore, the cutting elements scrape across the surface of the formation and shear away the underlying formation.

Impregnated diamond rotary drill bits may be used for drilling hard or abrasive rock formations such as sandstones. Typically, an impregnated diamond drill bit has a solid head or crown that is cast in a mold. The crown is attached to a steel shank that has a threaded end that may be used to attach the crown and steel shank to a drill string. The crown may have a variety of configurations and generally includes a cutting face comprising a plurality of cutting structures, which may comprise at least one of cutting segments, posts, and blades. The posts and blades may be integrally formed with the crown in the mold, or they may be separately formed and attached to the crown. Channels separate the posts and blades to allow drilling fluid to flow over the face of the bit.

Impregnated diamond bits may be formed such that the cutting face of the drill bit (including the posts and blades) comprises a particle-matrix composite material that includes diamond particles dispersed throughout a matrix material. The matrix material itself may comprise a particle-matrix composite material, such as particles of tungsten carbide, dispersed throughout a metal matrix material, such as a copper-based alloy.

It is known in the art to apply wear-resistant materials, such as "hardfacing" materials, to the formation-engaging surfaces of rotary drill bits to minimize wear of those surfaces of the drill bits cause by abrasion. For example, abrasion occurs at the formation-engaging surfaces of an earth-boring tool when those surfaces are engaged with and sliding relative to the surfaces of a subterranean formation in the presence of the solid particulate material (e.g., formation cuttings and detritus) carried by conventional drilling fluid. For example, hardfacing may be applied to cutting teeth on the cones of roller cone bits, as well as to the gage surfaces of the cones. Hardfacing also may be applied to the exterior surfaces of the curved lower end or "shirttail" of each bit leg, and other exterior surfaces of the drill bit that are likely to engage a formation surface during drilling.

The cutting elements used in such earth-boring tools often include polycrystalline diamond cutters (often referred to as "PDCs"), which are cutting elements that include a polycrystalline diamond (PCD) material. Such polycrystalline diamond-cutting elements are formed by sintering and bonding together relatively small diamond grains or crystals under conditions of high temperature and high pressure in the presence of a catalyst (such as, for example, cobalt, iron, nickel, or alloys and mixtures thereof) to form a layer of polycrystalline diamond material on a cutting element substrate. These processes are often referred to as high temperature/high pressure (or "HTHP") processes. The cutting element substrate may comprise a cermet material (i.e., a ceramic-metal composite material) such as, for example, cobalt-cemented tungsten carbide. In such instances, the cobalt (or other catalyst material) in the cutting element substrate may be drawn into the diamond grains or crystals during sintering and serve as a catalyst material for forming a diamond table from the diamond grains or crystals. In other methods, powdered catalyst material may be mixed with the diamond grains or crystals prior to sintering the grains or crystals together in an HTHP process.

Upon formation of a diamond table using an HTHP process, catalyst material may remain in interstitial spaces between the grains or crystals of diamond in the resulting polycrystalline diamond table. The presence of the catalyst material in the diamond table may contribute to thermal damage in the diamond table when the cutting element is heated during use due to friction at the contact point between the cutting element and the formation. Polycrystalline diamond-cutting elements in which the catalyst material remains in the diamond table are generally thermally stable up to a temperature of about 750° Celsius, although internal stress within the polycrystalline diamond table may begin to develop at temperatures exceeding about 350° Celsius. This internal stress is at least partially due to differences in the rates of thermal expansion between the diamond table and the cutting element substrate to which it is bonded. This differential in thermal expansion rates may result in relatively large compressive and tensile stresses at the interface between the diamond table and the substrate, and may cause the diamond table to delaminate from the substrate. At temperatures of about 750° Celsius and above, stresses within the diamond table may increase significantly due to differences in the coefficients of thermal expansion of the diamond material and the catalyst material within the diamond table itself. For example, cobalt thermally expands significantly faster than diamond, which may cause cracks to form and propagate within the diamond table, eventually leading to deterioration of the diamond table and ineffectiveness of the cutting element.

In order to reduce the problems associated with different rates of thermal expansion in polycrystalline diamond-cutting elements, so-called "thermally stable" polycrystalline diamond (TSD) cutting elements have been developed. Such a thermally stable polycrystalline diamond-cutting element may be formed by leaching the catalyst material (e.g., cobalt) out from interstitial spaces between the diamond grains in the diamond table using, for example, an acid. All of the catalyst material may be removed from the diamond table, or only a portion may be removed. Thermally stable polycrystalline diamond-cutting elements in which substantially all catalyst material has been leached from the diamond table have been reported to be thermally stable up to a temperatures of about 1200° Celsius. It has also been reported, however, that such fully leached diamond tables are relatively more brittle and vulnerable to shear, compressive, and tensile stresses than are non-leached diamond tables. In an effort to provide cutting elements having diamond tables that are more thermally stable relative to non-leached diamond tables, but that are also relatively less brittle and vulnerable to shear, compressive, and tensile stresses relative to fully leached diamond tables, cutting elements have been provided that include a diamond table in which only a portion of the catalyst material has been leached from the diamond table.

BRIEF SUMMARY

In some embodiments, the disclosure includes a cutting element comprising a volume of superabrasive material. The volume of superabrasive material comprises a front-cutting surface, an end-cutting surface, a cutting edge proximate an intersection between the front-cutting surface and the end-cutting surface, a first lateral side surface extending between and intersecting each of the front-cutting surface and the end-cutting surface, and a second lateral side surface extending between and intersecting each of the front-cutting surface and the end-cutting surface on an opposing side of the cutting element from the first lateral side surface.

In certain embodiments, a cutting element for an earth-boring tool comprises a volume of superabrasive material. The volume of superabrasive material comprises a front-cutting surface, a back surface on an opposing side of the cutting element from the front-cutting surface, an end-cutting surface, a base end surface on an opposing side of the cutting element from the end-cutting surface, a cutting edge proximate an intersection between the front-cutting surface and the end-cutting surface, a first lateral side surface extending between and intersecting each of the front-cutting surface and the end-cutting surface, and a second lateral side surface extending between and intersecting each of the front-cutting surface and the end-cutting surface on an opposing side of the cutting element from the first lateral side surface. The front-cutting surface has an average width less than an average width of the back surface.

An earth-boring tool may comprise a bit body and at least one cutting element attached to the bit body. The at least one cutting element comprises a front-cutting surface, an end-cutting surface, a cutting edge proximate an intersection between the front-cutting surface and the end-cutting surface, a first lateral side surface extending between and intersecting each of the front-cutting surface and the end-cutting surface, and a second lateral side surface extending between and intersecting each of the front-cutting surface and the end-cutting surface on an opposing side of the cutting element from the first lateral side surface.

BRIEF DESCRIPTION OF THE DRAWINGS

While the specification concludes with claims particularly pointing out and distinctly claiming that which are regarded as embodiments of the present invention, advantages of embodiments of the disclosure may be more readily ascertained from the description of certain example embodiments set forth below, when read in conjunction with the accompanying drawings, in which:

DETAILED DESCRIPTION

The illustrations presented herein are not meant to be actual views of any particular cutting element, earth-boring tool, or portion of such a cutting element or tool, but are merely idealized representations that are employed to describe embodiments of the present disclosure. Additionally, elements common between figures may retain the same numerical designation.

Figure 1:
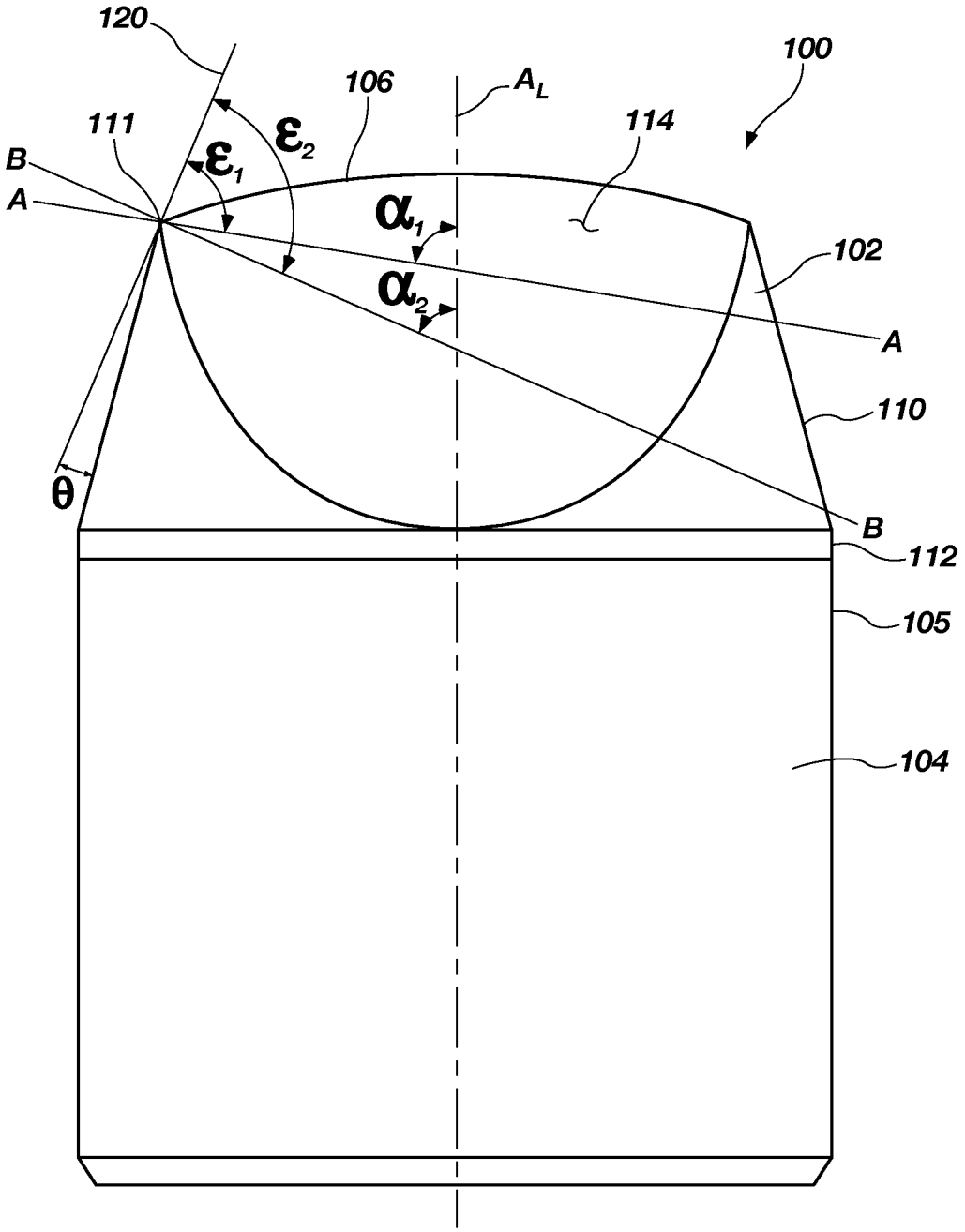
FIG. 1 is a side elevation view of an embodiment of a cutting element of the disclosure.

FIG. 1 is a side elevation view of an embodiment of an at least partially formed cutting element 100. The cutting element 100 includes a volume of superabrasive material (superabrasive material includes polycrystalline diamond material and/or cubic boron nitride), which, though it need not include diamond, is referred to for simplicity herein as a diamond table 102, on a substrate 104. The substrate 104 may comprise, for example, a cemented carbide material such as cobalt-cemented tungsten carbide. In additional embodiments, the entire cutting element 100 may be at least substantially comprised of superabrasive material. In yet further embodiments, the entire cutting element 100 may be at least substantially comprised of a cemented carbide material such as cobalt-cemented tungsten carbide.

The cutting element 100 may be polyhedral, but may be elongated and may have a longitudinal axis $A_L$. The cutting element 100 may be generally cylindrical. The diamond table 102 may include a generally cylindrical lateral side surface 112 that is generally coextensive and continuous with a generally cylindrical lateral side surface 105 of the substrate 104. The diamond table 102 may also include a curved end-cutting surface 106, and a frustoconical lateral side surface 110 extending between the generally cylindrical lateral side surface 112 and the curved end-cutting surface 106 on two sides of the cutting element 100, which are the left side of the cutting element 100 and the right side of the cutting element 100 from the perspective of in FIG. 1. The diamond table 102 may also include two flat planar chamfer surfaces 114 on two sides (e.g., opposing sides) of the cutting element 100, which are the front and back sides of the cutting element 100 from the perspective of FIG. 1. Thus, only one of the flat planar chamfer surfaces 114 is visible in FIG. 1.

Figure 8:
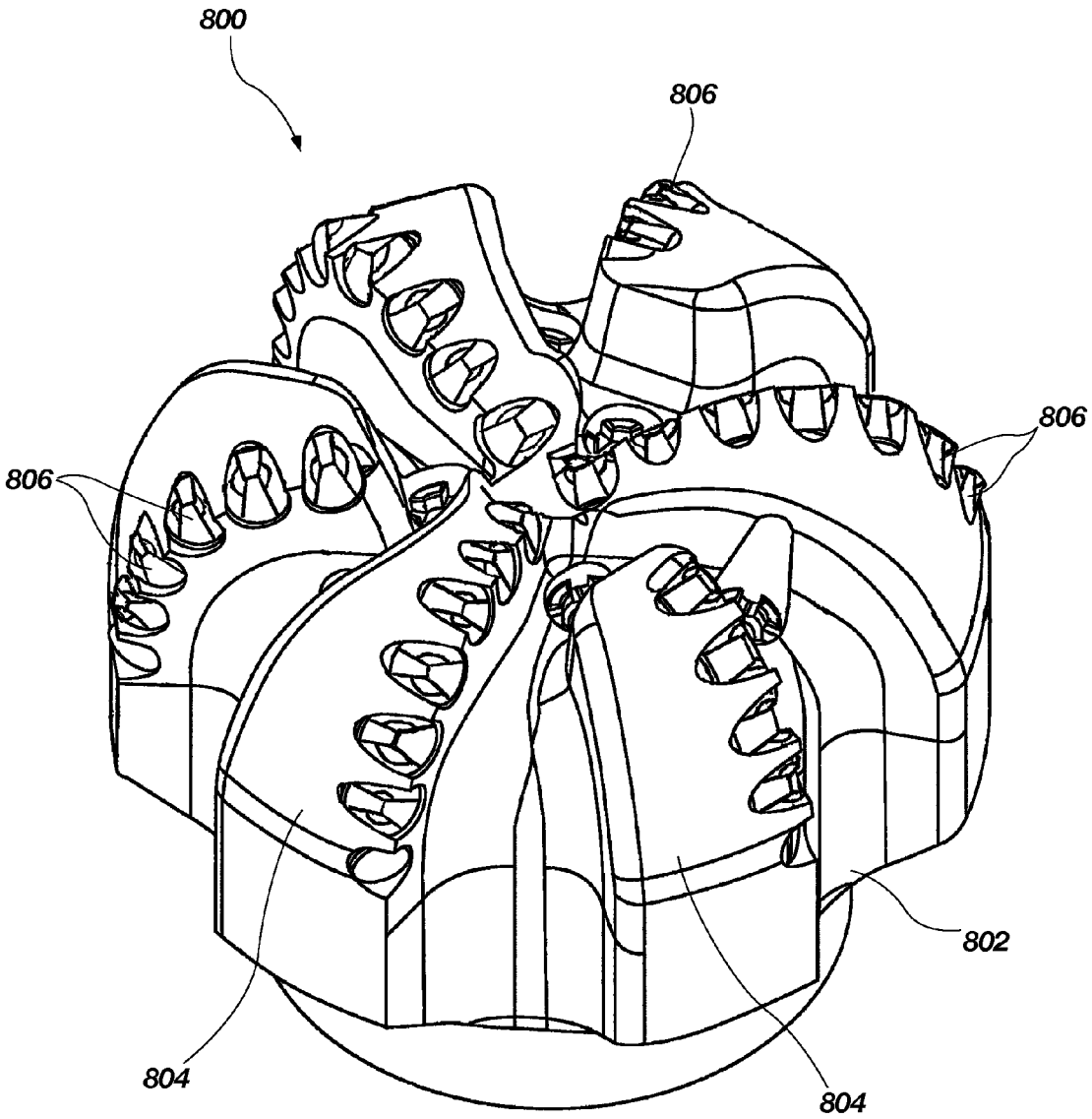
FIG. 8 is a perspective view of an earth-boring tool that may include any of the embodiments of cutting elements described herein.

As known to those of ordinary skill in the art, the cutting element 100 may be attached to an earth-boring tool, such as an earth-boring rotary drill bit (e.g., a fixed-cutter rotary drill bit), in such a manner that the diamond table 102 of the cutting element 100 will contact a surface of the formation within a wellbore as the earth-boring tool is used in a drilling or reaming process to form the wellbore. Referring briefly to FIG. 8, an earth-boring tool 800 may include a plurality of cutting elements 806, such as cutting elements 100 shown in FIG. 1.

Referring again to FIG. 1, the cutting element 100 may be mounted on an earth-boring tool such that an edge 111 of the diamond table 102 proximate the intersection between the curved endcutting surface 106 and the frustoconical lateral side surface 110 will contact an exposed surface of a subterranean formation within a wellbore, which surface is represented by the line 120 in FIG. 1. In other words, a portion of the frustoconical lateral side surface may be a front-cutting surface in contact with an exposed surface of a subterranean formation within a wellbore. As shown in FIG. 1, an angle θ between the frustoconical lateral side surface 110 and the surface of a subterranean formation (represented by line 120) within a wellbore may be from about two degrees (2°) to about thirty degrees (30°) (e.g., about fifteen degrees) (15°).

The cutting element 100 may be mounted on an earth-boring tool in an orientation that includes a physical side rake angle, or it may be mounted neutrally without any side rake angle. The cutting element 100 also may be mounted on an earth-boring tool in an orientation that includes a physical positive back rake angle, a physical negative back rake angle (i.e., a forward rake angle), or neutrally without any physical back rake angle (or forward rake angle).

By modifying the cutting element 100 shown in FIG. 1 to include a planar end-cutting surface (as opposed to a curved end-cutting surface 106 as shown in FIG. 1) oriented at an acute angle α greater than zero degrees (0°) and less than ninety degrees (90°) to the longitudinal axis $A_L$ of the cutting element 100, the cutting element 100 may be caused to exhibit an effective positive back rake angle, even when the cutting element 100 is mounted on an earth-boring tool in an orientation that includes a physical negative back rake angle (i.e., a forward rake angle), or neutrally without any physical back rake angle (or forward rake angle). The magnitude of the effective positive back rake angle may be at least partially determined by the magnitude of the acute angle $\alpha$ between the longitudinal axis $A_L$ of the cutting element 100 and the planar end-cutting surface.

Figure 2A:
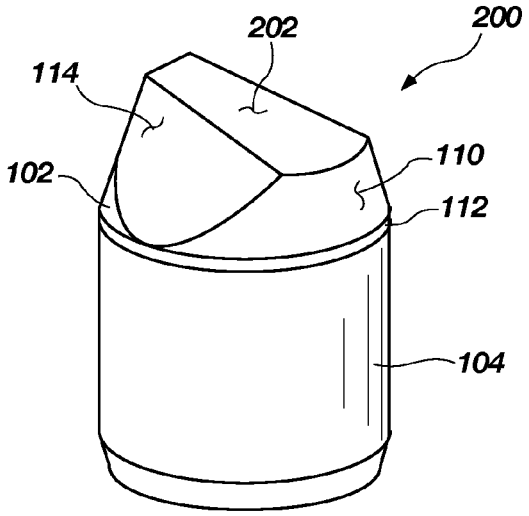
FIG. 2A is a perspective view of another embodiment of a cutting element of the disclosure that may be provided by forming a planar surface on the cutting element shown in FIG. 1 along the plane illustrated by line A-A shown in FIG. 1.
Figure 2B:
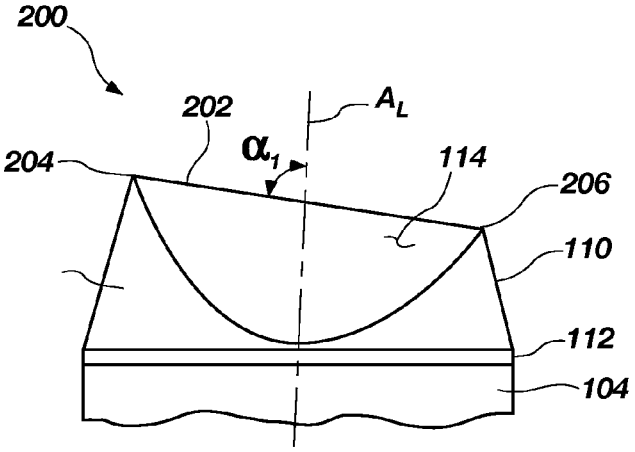
FIG. 2B is an enlarged, partial side elevation view of the cutting element shown in FIG. 2A.
Figure 2C:
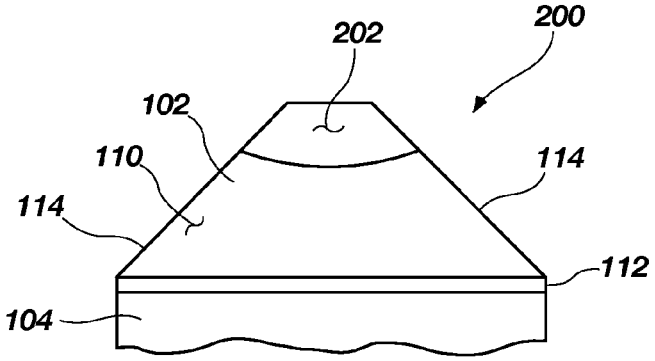
FIG. 2C is an enlarged, partial front elevation view of the cutting element shown in FIGS. 2A and 2B.

For example, FIGS. 2A through 2C illustrate another embodiment of a cutting element 200 that may be provided by forming a planar end-cutting surface 202 on the cutting element 100 shown in FIG. 1 along the plane illustrated by line A-A in FIG. 1. As shown in FIG. 1, line A-A (and, hence, the planar end-cutting surface 202) is oriented at an acute angle $\alpha_1$ to the longitudinal axis $A_L$ of the cutting element 200.

Figure 3A:
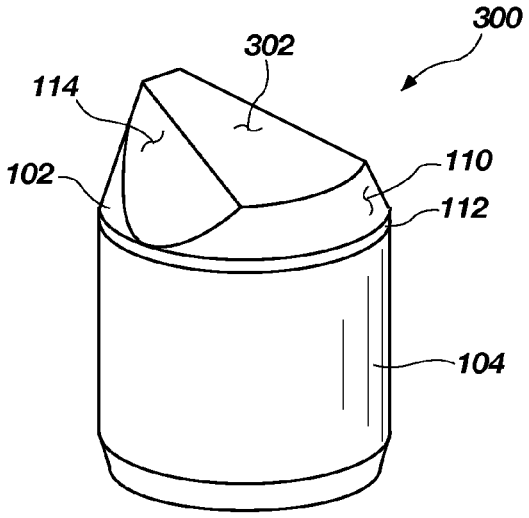
FIG. 3A is a perspective view of another embodiment of a cutting element of the disclosure that may be provided by forming a planar surface on the cutting element shown in FIG. 1 along the plane illustrated by line B-B shown in FIG. 1.
Figure 3B:
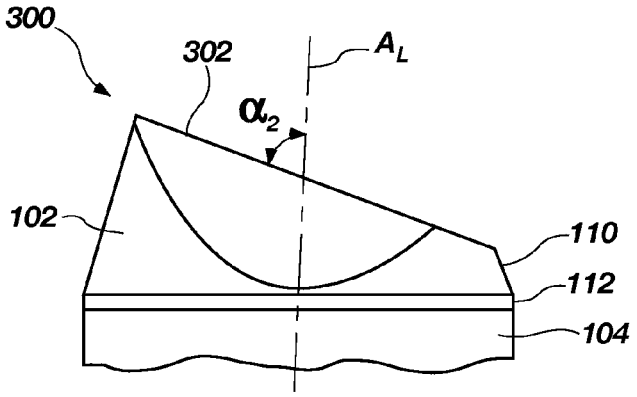
FIG. 3B is an enlarged, partial side elevation view of the cutting element shown in FIG. 3A.
Figure 3C:
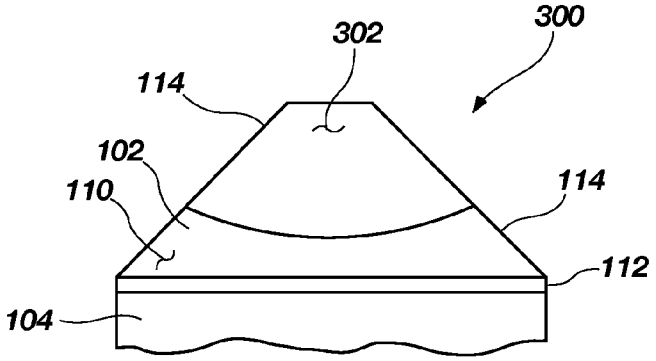
FIG. 3C is an enlarged, partial front elevation view of the cutting element shown in FIGS. 3A and 3B.

As another example, FIGS. 3A through 3C illustrate an embodiment of a cutting element 300 that may be provided by forming a planar end-cutting surface 302 on the cutting element 100 shown in FIG. 1 along the plane illustrated by line B-B in FIG. 1. As shown in FIG. 1, line B-B (and, hence, the planar end-cutting surface 302) is oriented at an acute angle $\alpha_2$ to the longitudinal axis $A_L$ of the cutting element 300.

As will be appreciated by comparing lines A-A and B-B in FIG. 1, the acute angle $\alpha_2$ between the planar end-cutting surface 302 and the longitudinal axis $A_L$ of the cutting element 300 is less than the acute angle $\alpha_1$ between the planar end-cutting surface 202 and the longitudinal axis $A_L$ of the cutting element 200.

With continued reference to FIG. 1, the acute angle $\alpha_1$ between the planar end-cutting surface 202 and the longitudinal axis $A_L$ of the cutting element 200 may be selected such that the angle $\epsilon_1$ between the planar end-cutting surface 202 and the surface of a subterranean formation within a wellbore (represented by line 120) may be less than ninety degrees (90°), and, hence, such that the cutting element 200 of FIGS. 2A through 2C exhibits an effective negative back rake angle (i.e., an effective forward rake angle).

As also shown in FIG. 1, the acute angle $\alpha_2$ between the planar end-cutting surface 302 and the longitudinal axis $A_L$ of the cutting element 300 may be selected such that the angle $\epsilon_2$ between the planar end-cutting surface 302 and the surface of a subterranean formation within a wellbore (represented by line 120) may be greater than ninety degrees (90°), and, hence, such that the cutting element 200 of FIGS. 3A through 3C exhibits an effective positive back rake angle (i.e., an effective back rake angle).

Figure 4:
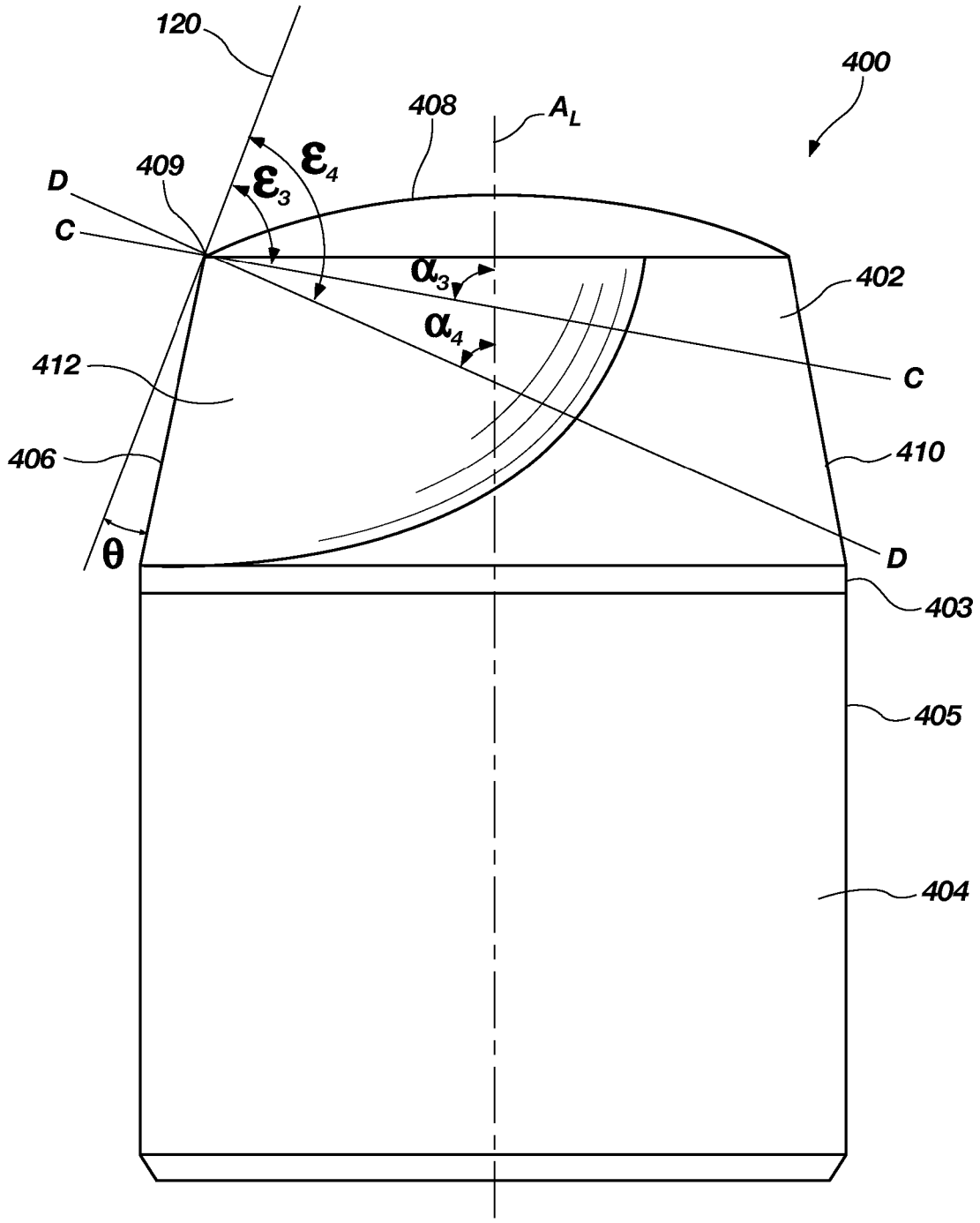
FIG. 4 is a side elevation view of another embodiment of a cutting element of the disclosure.

FIG. 4 is a side elevation view of another embodiment of an at least partially formed cutting element 400. The cutting element 400 may include a volume of polycrystalline diamond material (or another superabrasive material, such as cubic boron nitride), which is referred to herein as a diamond table 402, on a substrate 404. The substrate 404 may comprise, for example, a cemented carbide material such as cobalt-cemented tungsten carbide. In additional embodiments, the entire cutting element 400 may be at least substantially comprised of polycrystalline diamond material. In yet further embodiments, the entire cutting element 400 may be at least substantially comprised of a cemented carbide material such as cobalt-cemented tungsten carbide.

The cutting element 400 may be polyhedral, but may be elongated and have a longitudinal axis $A_L$. In some embodiments, the cutting element 400 may be generally cylindrical in shape. The diamond table 402 may include a generally cylindrical lateral side surface 403 that is generally coextensive and continuous with a generally cylindrical lateral side surface 405 of the substrate 404. A frustoconical surface 410 extends between the generally cylindrical lateral side surface 403 and an end-cutting surface 408 around at least a portion of the cutting element 400. The diamond table 402 also includes a front-cutting surface 406, a first curved, concave lateral side surface 412 extending between the front-cutting surface 406 and the generally frustoconical lateral side surface 410, and a second curved, concave lateral side surface 416 (not shown in FIG. 4; see, e.g., FIGS. 5C and 6C) extending between the front-cutting surface 406 and the generally frustoconical lateral side surface 410. Each of the first curved, concave lateral side surface 412 and the second curved, concave lateral side surface 416 may also extend to the end-cutting surface 408. The first curved, concave lateral side surface 412 and the second curved, concave lateral side surface 416 may be on opposing sides of the cutting element 400. A cutting edge 409 is located proximate an intersection between the front-cutting surface 406 and the end-cutting surface 408. Though illustrated in FIG. 4 as a sharp edge defined by the intersection between the front-cutting surface 406 and the end-cutting surface 408, the cutting edge 409 may include a chamfer or a radius. Such a chamfer or radius may improve durability of the cutting element 400.

The front-cutting surface 406 may be at least substantially planar in some embodiments (as shown in FIG. 4), but may be convexly curved in additional embodiments. Similarly, the end surface 408 may be convexly curved in some embodiments (as shown in FIG. 4), but may be at least substantially planar in additional embodiments.

The cutting element 400 may be attached to an earth-boring tool, such as an earth-boring rotary drill bit (e.g., a fixed-cutter rotary drill bit), in such a manner that the diamond table 402 of the cutting element 400 will contact a surface of the formation within a wellbore as the earth-boring tool is used in a drilling or reaming process to form the wellbore. Referring briefly to FIG. 8, an earth-boring tool 800 may include a plurality of cutting elements 806, such as cutting elements 400 shown in FIG. 4.

When the cutting element 400 is attached to an earth-boring tool, and as the cutting element 400 is used to cut formation material, the first curved lateral side surface 412 and the second curved lateral side surface 416 may direct cuttings and crushed formation material away from the surface of the earth-boring tool to which the cutting element 400 is attached. For example, in embodiments in which the cutting element 400 is attached to a blade of a fixed-cutter earth-boring rotary drill bit, the cutting element 400 may direct cuttings and crushed formation material away from the surface of the blade of the drill bit.

The concave shape of the first curved lateral side surface 412 and the second curved lateral side surface 416 may also direct cuttings and crushed formation material around the cutting element 400 and outwardly toward the lateral sides of the cutting element 400. In some embodiments, the cutting element 400 may be attached to an earth-boring tool proximate or adjacent conventional shear cutting elements (e.g., between two shear cutting elements) as disclosed in, for example, provisional U.S. Patent Application Ser. No. 61/290,401, filed Dec. 28, 2009 and entitled "Drill Bits And Other Earth-Boring Tools Having Differing Cutting Elements On A Common Blade, And Related Methods," U.S. patent application Ser. No. 12/793,396, filed Jun. 3, 2010 and entitled "Earth-Boring Tools Having Differing Cutting Elements on a Blade and Related Methods," the disclosures of each of which are incorporated herein in their entirety by this reference. In such embodiments, the concave shape of the first curved lateral side surface 412 and the second curved lateral side surface 416 may also direct cuttings and crushed formation material generated by the cutting element 400 toward the cutting path of one or more adjacent shear cutting elements, which may then further assist in cutting and evacuation of the formation cuttings and crushed formation material generated by the cutting element 400.

The first curved lateral side surface 412 and the second curved lateral side surface 416 may have similar (e.g., identical or mirror-image) or different geometries, and the geometries of each may be individually tailored to improve performance of the cutting element 400 during drilling operations.

Thus, the concave shape of the first curved lateral side surface 412 and the second curved lateral side surface 416 of the cutting element 400 may reduce the occurrence of packing and accumulation of formation cuttings around the cutting element 400, which is referred to in the art as "balling." Such balling of formation material around cutting elements may reduce the effectiveness of the cutting elements.

The cutting element 400 may be mounted on an earth-boring tool such that the cutting edge 409 of the diamond table 402 located proximate the intersection between the front-cutting surface 406 and the end-cutting surface 408 will contact an exposed surface of a subterranean formation within a wellbore, which surface is represented by line 120 in FIG. 4. As shown in FIG. 4, an angle θ between the front-cutting face 406 (and/or the frustoconical lateral side surface 410) and the surface of a subterranean formation 122 within a wellbore may be from about two degrees (2°) to about thirty degrees (30°) (e.g., about fifteen degrees) (15°).

The cutting element 400 may be mounted on an earth-boring tool in an orientation that includes a physical side rake angle, or it may be mounted neutrally without any side rake angle. The cutting element 400 also may be mounted on an earth-boring tool in an orientation that includes a physical positive back rake angle, a physical negative back rake angle (i.e., a forward rake angle), or neutrally without any physical back rake angle (or forward rake angle).

In some embodiments, the end surface 408 may be generally planar, and may be oriented at an acute angle α (for example, $\alpha_3$, $\alpha_4$ in FIG. 4) greater than zero degrees (0°) and less than ninety degrees (90°) to the longitudinal axis $A_L$ of the cutting element 400. In such embodiments, the cutting element 400 optionally may be mounted on an earth-boring tool in such a manner as to cause the cutting element 400 to exhibit an effective positive back rake angle, even though the cutting element 400 is mounted on an earth-boring tool in an orientation that includes a physical negative back rake angle (i.e., a forward rake angle), or neutrally without any physical back rake angle (or forward rake angle) as determined by the angle between the longitudinal axis $A_L$ of the cutting element 400 and the surface of the formation. The magnitude of the effective positive back rake angle may be at least partially determined by the magnitude of the acute angle α between the longitudinal axis $A_L$ of the cutting element 400 and the planar end surface.

Figure 5A:
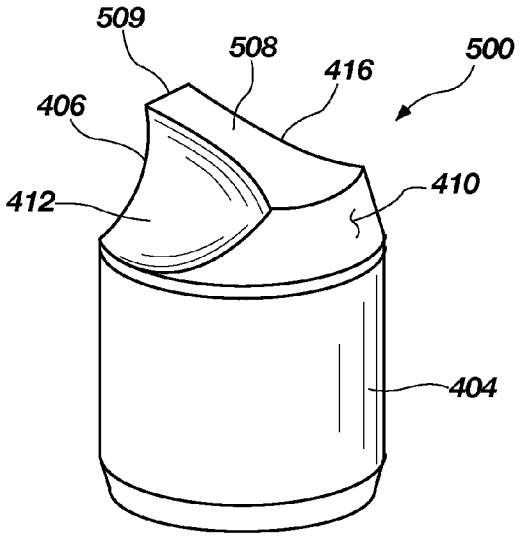
FIG. 5A is a perspective view of another embodiment of a cutting element of the disclosure that may be provided by forming a planar surface on the cutting element shown in FIG. 4 along the plane illustrated by line C-C shown in FIG. 4.
Figure 5B:
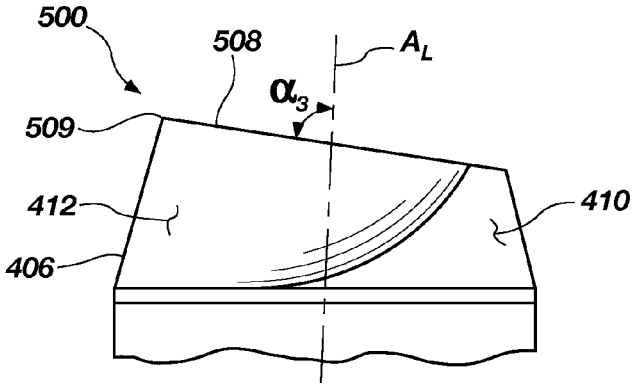
FIG. 5B is an enlarged, partial side elevation view of the cutting element shown in FIG. 5A.
Figure 5C:
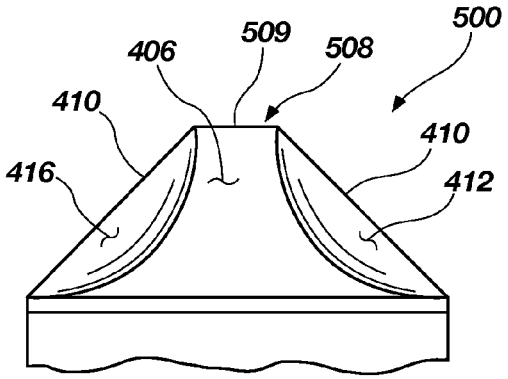
FIG. 5C is an enlarged, partial front elevation view of the cutting element shown in FIGS. 5A and 5B.

For example, FIGS. 5A through 5C illustrate another embodiment of a cutting element 500 that may be provided by forming a planar end surface 508 on the cutting element 400 shown in FIG. 4 along the plane illustrated by line C-C in FIG. 4. As shown in FIG. 4, line C-C (and, hence, the planar end surface 508) is oriented at an acute angle $\alpha_3$ to the longitudinal axis $A_L$ of the cutting element 500. A cutting edge 509 is located proximate an intersection between the front-cutting surface 406 and the end-cutting surface 508. The cutting edge 509 may be chamfered or radiused.

Figure 6A:
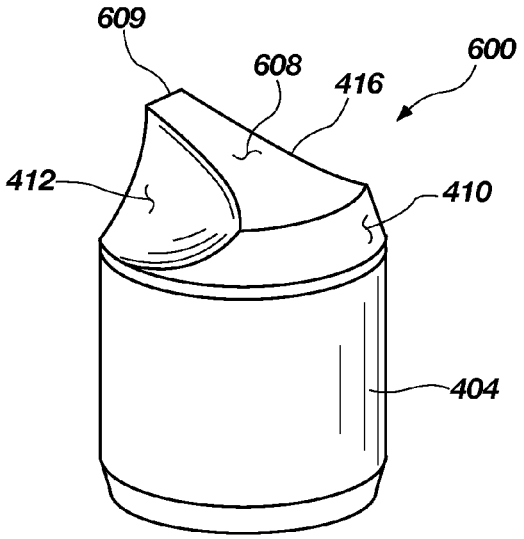
FIG. 6A is a perspective view of another embodiment of a cutting element of the disclosure that may be provided by forming a planar surface on the cutting element shown in FIG. 4 along the plane illustrated by line D-D shown in FIG. 4.
Figure 6B:
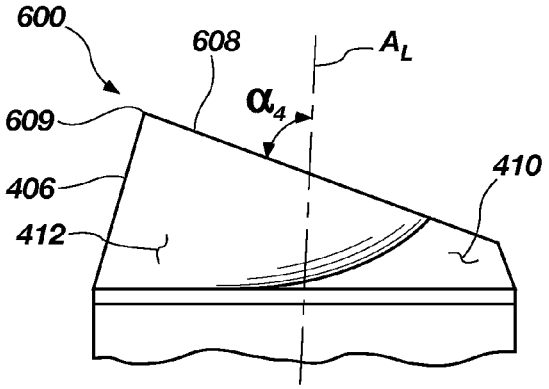
FIG. 6B is an enlarged, partial side elevation view of the cutting element shown in FIG. 6A.
Figure 6C:
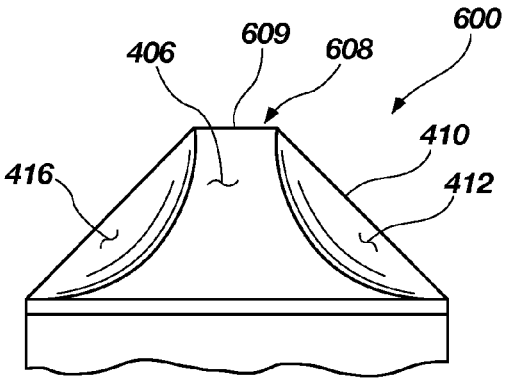
FIG. 6C is an enlarged, partial front elevation view of the cutting element shown in FIGS. 6A and 6B.

As another example, FIGS. 6A through 6C illustrate an embodiment of a cutting element 600 that may be provided by forming a planar end surface 608 on the cutting element 400 shown in FIG. 4 along the plane illustrated by line D-D in FIG. 4. As shown in FIG. 4, line D-D (and, hence, the planar end surface 608) is oriented at an acute angle $\alpha_4$ to the longitudinal axis $A_L$ of the cutting element 600. A cutting edge 609 is located proximate an intersection between the front-cutting surface 406 and the end-cutting surface 608. The cutting edge 609 may be chamfered or radiused.

As will be appreciated by comparing lines C-C and D-D in FIG. 4, the acute angle $\alpha_4$ between the planar end surface 608 (as represented by line D-D) and the longitudinal axis $A_L$ of the cutting element 600 is less than the acute angle $\alpha_3$ between the planar end surface 508 (as represented by line C-C) and the longitudinal axis $A_L$ of the cutting element 500.

With continued reference to FIG. 4, the acute angle $\alpha_3$ between the planar end surface 508 and the longitudinal axis $A_L$ of the cutting element 500 may be selected such that the angle $\epsilon_3$ between the planar end surface 508 and the surface of a subterranean formation within a wellbore (represented by line 120) may be less than ninety degrees (90°), and, hence, such that the cutting element 500 of FIGS. 5A through 5C exhibits an effective negative back rake angle (i.e., an effective forward rake angle).

As also shown in FIG. 4, the acute angle $\alpha_4$ between the planar end surface 608 and the longitudinal axis $A_L$ of the cutting element 600 may be selected such that the angle $\alpha_t$ between the planar end surface 608 and the surface of a subterranean formation within a wellbore (represented by line 120) may be greater than ninety degrees (90°), and, hence, such that the cutting element 600 of FIGS. 6A through 6C exhibits an effective positive back rake angle (i.e., an effective back rake angle).

Figure 7A:
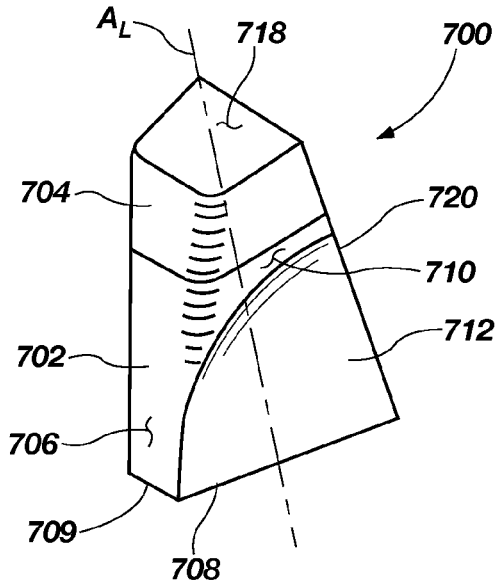
FIG. 7A is a perspective view of another embodiment of an at least partially formed cutting element of the present disclosure.

FIG. 7A is a perspective view of another embodiment of an at least partially formed cutting element 700. The cutting element 700 includes a volume of superabrasive material (polycrystalline diamond material and/or cubic boron nitride), which is referred to herein as a diamond table 702, on a substrate 704. The substrate 704 may comprise, for example, a cemented carbide material such as cobalt-cemented tungsten carbide. In additional embodiments, the entire cutting element 700 may be at least substantially comprised of polycrystalline diamond material. In yet further embodiments, the entire cutting element 700 may be at least substantially comprised of a cemented carbide material such as cobalt-cemented tungsten carbide.

The cutting element 700 may be polygonal in shape. The diamond table 702 may include a front-cutting surface 706, an end-cutting surface 708, a first generally planar lateral side surface 710, a first curved, concave lateral side surface 712 extending between the front-cutting surface 706 and the first generally planar lateral side surface 710, a second generally planar lateral side surface 714 (shown in FIG. 7B), and a second curved, concave lateral side surface 716 (shown in FIG. 7B) extending between the front-cutting surface 706 and the second generally planar lateral side surface 714. A cutting edge 709 is located proximate an intersection between the front-cutting surface 706 and the end-cutting surface 708. The cutting edge 709 may be chamfered or radiused. The cutting element 700 also may include a base end surface 718 on an opposing end of the cutting element 700 from the end-cutting surface 708, and a back surface 720 on an opposing side of the cutting element 700 from the front-cutting surface 706. In some embodiments, one or both of the base end surface 718 and the back surface 720 may be at least substantially planar.

The cutting element 700 may have a cutting element axis $A_L$ defined as an axis extending between a center of the end-cutting surface 708 and a center of the base end surface 718 of the cutting element 700. An average width of the front-cutting surface 706 measured perpendicularly to the cutting element axis $A_L$ may be less than an average width of the back surface 720 measured perpendicularly to the cutting element axis $A_L$. For example, the average width of the front-cutting surface 706 may be about ninety-five percent (95%) or less of the average width of the back surface 720 in some embodiments.

Figure 7B:
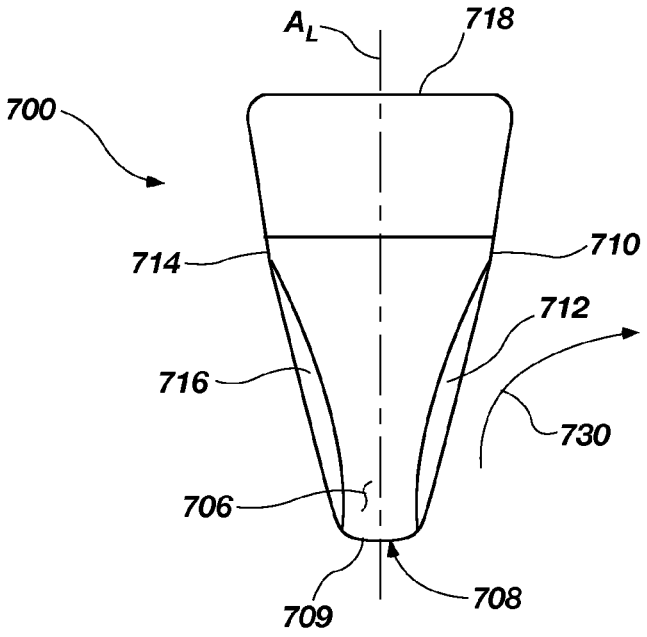
FIG. 7B is a plan view of a front-cutting surface of the cutting element shown in FIG. 7A.

FIG. 7B is a plan view of the front-cutting surface 706 of the cutting element 700 shown in FIG. 7A. The front-cutting surface 706 may be convexly curved in some embodiments (as shown in FIGS. 7A and 7B), but may be at least substantially planar in additional embodiments. Similarly, the end-cutting surface 708 may be at least substantially planar in some embodiments (as shown in FIGS. 7A and 7B), but may be convexly curved in additional embodiments.

The cutting element 700 may be attached to an earth-boring tool, such as an earth-boring rotary drill bit (e.g., a fixed-cutter rotary drill bit). When the cutting element 700 is attached to an earth-boring tool, and as the cutting element 700 is used to cut formation material, the first concave lateral side surface 712 and the second concave lateral side surface 716 may direct cuttings and crushed formation material around and laterally outward from the cutting element 700 (e.g., along a path 730), in a manner similar to that previously described herein in relation to the first and second curved lateral side surfaces 412, 114 of the cutting element 400 of FIG. 4. The first concave lateral side surface 712 and the second concave lateral side surface 716 may have similar or different geometries, and the geometries of each may be individually tailored to improve performance of the cutting element 700 during drilling operations.

As shown in FIG. 8, an earth-boring tool 800 may include a bit body 802 and a plurality of blades 804. The earth-boring tool 800 shown in FIG. 8 comprises a fixed-cutter rotary drill bit, although embodiments of the invention also include other known types of earth-boring tools including, for example, other types of drill bits (e.g., roller cone drill bits, diamond impregnated drill bits, coring bits, and percussion bits), casing and liner drilling tools, reamers, or other hole-opening tools, as well as stabilizers, packers, or steerable assemblies such as steerable liner systems. A plurality of cutting elements 806 may be mounted to the bit body 802, such as to each of the blades 804. For example, cutting elements 806 may be mounted to leading edges of blades 804. Cutting elements 806 may include any of cutting elements 100, 200, 300, 400, 500, 600, and/or 700, as described herein. Cutting elements 806 may be attached to the bit body 802 by any method known in the art, such as by brazing, welding, co-sintering, etc. The cutting elements 806 may be substantially similar to one another in material composition and geometry, or may be different from other cutting elements 806. For example, cutting elements 806 in a cone region of the earth-boring tool may have a different geometry than cutting elements 806 in a nose region, a shoulder region, or a gage region. The geometry and materials of each cutting element 806 may be selected to optimize abrasive properties of the earth-boring tool 800.

Certain regions of the superabrasive material of embodiments of cutting elements (e.g., diamond tables 102, 402, or 702), or the entire volume of superabrasive material, optionally may be processed (e.g., etched) to remove metal material (e.g., such as a metal catalyst used to catalyze formation of diamond-to-diamond bonds between diamond crystals (i.e., grains) in the superabrasive material) from between the interbonded diamond grains of the superabrasive material, such that the superabrasive material is relatively more thermally stable.

Furthermore, certain exposed surfaces of the superabrasive material of embodiments of cutting elements (e.g., diamond tables 102, 402, or 702), or all exposed surfaces of the superabrasive material, optionally may be polished to increase the smoothness of the surfaces in such a manner as to reduce sticking of formation materials to the surfaces during drilling operations.

The enhanced shape of the cutting elements described herein may be used to improve the behavior and durability of the cutting elements when drilling in relatively hard rock formations. Furthermore, the shape of the cutting elements may be used to provide an effective positive or negative back rake angle, regardless of whether the cutting element has a physical positive or negative back rake angle. The shape of the cutting elements described herein may provide a plowing cutting action when mounted on an earth-boring tool and when used to cut a subterranean formation. In other words, the cutting elements may remove formation material using crushing and/or gouging mechanisms, in addition to, or in place of, shearing mechanisms employed by conventional shear cutting elements.

Though the cutting elements 100 and 400 in FIGS. 1 and 4 are shown to contact the surface of a subterranean formation (represented by line 120) along one side of the cutting element (i.e., the edge 111 or the cutting surface 409), the cutting element may be mounted in an earth-boring tool such that an opposite side of the cutting element contacts the subterranean formation. For example, as shown in FIG. 2B, either the surface 204 (corresponding to the edge 111 in FIG. 1) or the surface 206 may contact the subterranean formation. The back rake angle and/or the side rake angle may vary based on which surface 204 or 206 is configured to contact the subterranean formation. The cutting elements 300, 500, and 600 may be similarly configured.

Additional non-limiting example embodiments of the disclosure are described below.

Embodiment 1

A cutting element comprising a volume of superabrasive material. The volume of superabrasive material comprises a front-cutting surface, an end-cutting surface, a cutting edge proximate an intersection between the front-cutting surface and the end-cutting surface, a first lateral side surface extending between and intersecting each of the front-cutting surface and the end-cutting surface, and a second lateral side surface extending between and intersecting each of the front-cutting surface and the end-cutting surface on an opposing side of the cutting element from the first lateral side surface.

Embodiment 2

The cutting element of Embodiment 1, wherein the cutting element is at least substantially comprised of the volume of superabrasive material.

Embodiment 3

The cutting element of Embodiment 1, further comprising a cemented carbide substrate, the volume of superabrasive material disposed on the cemented carbide substrate.

Embodiment 4

The cutting element of any of Embodiments 1 through 3, wherein each of the first lateral side surface and the second lateral side surface comprises a concave surface.

Embodiment 5

The cutting element of any of Embodiments 1 through 3, wherein each of the first lateral side surface and the second lateral side surface comprises a substantially planar surface.

Embodiment 6

The cutting element of any of Embodiments 1 through 5, wherein the end-cutting surface comprises an at least substantially planar surface.

Embodiment 7

The cutting element of any of Embodiments 1 through 5, wherein the end-cutting surface comprises a convexly curved surface.

Embodiment 8

The cutting element of any of Embodiments 1 through 7, wherein the front-cutting surface comprises an at least substantially planar surface.

Embodiment 9

The cutting element of any of Embodiments 1 through 7, wherein the front-cutting surface comprises a convexly curved surface.

Embodiment 10

The cutting element of any of Embodiments 1 through 9, wherein the cutting element is generally cylindrical.

Embodiment 11

The cutting element of any of Embodiments 1 through 9, wherein the volume of superabrasive material further comprises at least one of an at least substantially planar back surface on an opposing side of the cutting element from the front-cutting surface; and an at least substantially planar base end surface on an opposing side of the cutting element from the end-cutting surface.

Embodiment 12

The cutting element of any of Embodiments 1 through 3, wherein the front-cutting surface comprises a frustoconical lateral side surface and wherein the first and second lateral side surfaces comprise flat planar chamfer surfaces intersecting each of the front-cutting surface and the end-cutting surface.

Embodiment 13

A cutting element for an earth-boring tool, the cutting element comprising a volume of superabrasive material. The volume of superabrasive material comprises a front-cutting surface, a back surface on an opposing side of the cutting element from the front-cutting surface, an end-cutting surface, a base end surface on an opposing side of the cutting element from the end-cutting surface, a cutting edge proximate an intersection between the front-cutting surface and the end-cutting surface, a first lateral side surface extending between and intersecting each of the front-cutting surface and the end-cutting surface, and a second lateral side surface extending between and intersecting each of the front-cutting surface and the end-cutting surface on an opposing side of the cutting element from the first lateral side surface. The front-cutting surface has an average width less than an average width of the back surface.

Embodiment 14

The cutting element of Embodiment 13, wherein the average width of the front-cutting surface is about ninety-five percent (95%) or less of the average width of the back surface.

Embodiment 15

The cutting element of Embodiment 13 or Embodiment 14, wherein the front-cutting surface is at least substantially planar.

Embodiment 16

The cutting element of any of Embodiments 13 through 15, wherein each of the first lateral side surface and the second lateral side surface comprises a curved surface.

Embodiment 17

An earth-boring tool comprising a bit body and at least one cutting element attached to the bit body. The at least one cutting element comprises a front-cutting surface, an end-cutting surface, a cutting edge proximate an intersection between the front-cutting surface and the end-cutting surface, a first lateral side surface extending between and intersecting each of the front-cutting surface and the end-cutting surface, and a second lateral side surface extending between and intersecting each of the front-cutting surface and the end-cutting surface on an opposing side of the cutting element from the first lateral side surface.

Embodiment 18

The earth-boring tool of Embodiment 17, wherein at least one of the front-cutting surface, the end-cutting surface, the first lateral side surface, and the second lateral side surface comprises a curved surface.

Embodiment 19

A method of forming a cutting element, comprising forming a volume of superabrasive material. Forming the volume of superabrasive material comprises forming a cutting edge of the cutting element proximate an intersection between a front-cutting surface and an end-cutting surface, forming a first lateral side surface of the cutting element extending between and intersecting each of the front-cutting surface and the end-cutting surface, and forming a second lateral side surface of the cutting element extending between and intersecting each of the front-cutting surface and the end-cutting surface on an opposing side of the cutting element from the first lateral side surface.

Embodiment 20

The method of Embodiment 19, further comprising forming a planar end-cutting surface oriented at an acute angle to a longitudinal axis of the cutting element.

Embodiment 21

The method of Embodiment 19 or Embodiment 20, wherein each of forming a first lateral side surface and forming a second lateral side surface comprises forming a curved surface.

Embodiment 22

A method of forming an earth-boring tool, comprising forming a cutting element and attaching the cutting element to an earth-boring tool. Forming the cutting element comprises forming a cutting edge of the cutting element proximate an intersection between a front-cutting surface and an end-cutting surface, forming a first lateral side surface of the cutting element extending between and intersecting each of the front-cutting surface and the end-cutting surface, and forming a second lateral side surface of the cutting element extending between and intersecting each of the front-cutting surface and the end-cutting surface on an opposing side of the cutting element from the first lateral side surface.

Embodiment 23

The method of Embodiment 22, wherein attaching the cutting element to an earth-boring tool comprises attaching the cutting element to a fixed-cutter earth-boring rotary drill bit.

While the present disclosure has been set forth herein with respect to certain embodiments, those of ordinary skill in the art will recognize and appreciate that it is not so limited. Rather, many additions, deletions and modifications to the embodiments described herein may be made without departing from the scope of the invention as hereinafter claimed. In addition, features from one embodiment may be combined with features of another embodiment while still being encompassed within the scope of the invention as contemplated by the inventor.

What is claimed is:

1. A fixed-cutter bit, comprising:
a fixed-cutter bit body having a plurality of blades; and
at least one cutting element attached to a blade of the fixed-cutter bit body, the at least one cutting element comprising:
a substrate; and
a volume of superabrasive material bonded to the substrate at an interface, the volume of superabrasive material comprising:
an end cutting surface;
a first side chamfer surface;
a second side chamfer surface;
a lateral side cutting surface intersecting each of the first side chamfer surface and the second side chamfer surface; and
a cutting edge at an intersection of the end cutting surface and the lateral side cutting surface;
wherein the at least one cutting element is oriented on the blade such that a portion of the lateral side cutting surface contacts a point on an exposed surface of a subterranean formation before any portion of the end cutting surface contacts the point on the exposed surface when the fixed-cutter bit body is rotated within a wellbore.

2. The fixed-cutter bit of claim 1, wherein the at least one cutting element exhibits an effective positive back rake angle.

3. The fixed-cutter bit of claim 1, wherein the end cutting surface intersects each of the first side chamfer surface and the second side chamfer surface.

4. The fixed-cutter bit of claim 3, wherein the end cutting surface is substantially planar.

5. The fixed-cutter bit of claim 4, wherein the end-cutting surface is oriented at an acute angle greater than zero degrees (0°) and less than ninety degrees (90°) relative to a longitudinal axis of the cutting element, the longitudinal axis defined as an axis normal to a surface of the cutting element opposite the end-cutting surface.

6. The fixed-cutter bit of claim 1, wherein the at least one cutting element is generally cylindrical.

7. The fixed-cutter bit of claim 1, wherein the first side chamfer surface is discontinuous from the second side chamfer surface.

8. The fixed-cutter bit of claim 1, wherein the at least one cutting element is secured to a leading edge of the blade.

9. The fixed-cutter bit of claim 1, wherein the at least one cutting element comprises at least one polished surface.

10. The fixed-cutter bit of claim 1, wherein at least a portion of the lateral side cutting surface is frustoconical.

11. The fixed-cutter bit of claim 1, wherein at least a portion of the lateral side cutting surface is cylindrical.

12. The fixed-cutter bit of claim 1, wherein at least one of the first side chamfer surface and the second side chamfer surface is substantially planar.

13. The fixed-cutter bit of claim 1, wherein the first side chamfer surface and the second side chamfer surface have mirror-image geometries.

14. The fixed-cutter bit of claim 1, wherein at least a portion of the end cutting surface exhibits a linear profile in a plane extending longitudinally through the at least one cutting element, the plane extending along a longitudinal axis of the at least one cutting element and intersecting the portion of the cutting edge most distal from the interface.

15. The fixed-cutter bit of claim 14, wherein the linear profile of the at least a portion of the end cutting surface is oriented at an acute angle relative to the longitudinal axis of the cutting element.

16. A fixed-cutter bit, comprising:
a fixed-cutter bit body having a plurality of blades; and
at least one cutting element attached to a blade of the fixed-cutter bit body, the at least one cutting element comprising:
a volume of superabrasive material, comprising:
an end cutting surface;
a first side chamfer surface;
a second side chamfer surface;
a lateral side cutting surface intersecting each of the first side chamfer surface and the second side chamfer surface; and
a cutting edge at an intersection of the end cutting surface and the lateral side cutting surface;
a base surface; and
a longitudinal axis extending through the cutting surface and the base surface, wherein the longitudinal axis is perpendicular to the base surface;

wherein the at least one cutting element is oriented such that a portion of the lateral side cutting surface contacts a point on an exposed surface of a subterranean formation before any portion of the end cutting surface contacts the point on the exposed surface when the fixed-cutter bit body is rotated within a wellbore.

* * * * *